US005186645A

United States Patent [19]

Bixler

[11] Patent Number: 5,186,645

[45] Date of Patent: Feb. 16, 1993

[54] ELECTRICAL CONNECTOR LATCHING SYSTEM

[75] Inventor: Craig A. Bixler, Elmhurst, Ill.

[73] Assignee: Molex Incorporated, Lisle, Ill.

[21] Appl. No.: 783,956

[22] Filed: Oct. 29, 1991

[51] Int. Cl.[5] ..... H01R 13/627

[52] U.S. Cl. ..... 439/358; 439/368

[58] Field of Search ..... 439/355, 357, 358, 368, 439/350–354, 356

[56] References Cited

U.S. PATENT DOCUMENTS

| | | | |
|---|---|---|---|
| 3,706,954 | 9/1972 | Krafthefer | 439/65 |
| 3,774,141 | 11/1973 | Condon | 439/937 |
| 4,165,142 | 8/1979 | Grabau | 439/370 |
| 4,418,976 | 12/1983 | Lenzini et al. | 439/358 |
| 4,492,023 | 1/1985 | Schneider et al. | 439/937 |

FOREIGN PATENT DOCUMENTS

| | | | |
|---|---|---|---|
| 7705393 | 11/1977 | Netherlands | 439/358 |

*Primary Examiner*—Gary F. Paumen

*Attorney, Agent, or Firm*—A. A. Tirva

[57] ABSTRACT

A latching system is disclosed for use in an electrical connector system which includes a backplane connector mounted on a backplane of an electrical apparatus, along with a mating connector mateable with the backplane connector in a direction generally perpendicular to the backplane. The latching system includes a latching device independent of the backplane and mating connectors. The device includes a latch arm projecting from the backplane, and a hook portion engageable with a latching surface on the mating connector for holding the mating connector in mated condition with the backplane connector.

12 Claims, 1 Drawing Sheet

ELECTRICAL CONNECTOR LATCHING SYSTEM

FIELD OF THE INVENTION

This invention generally relates to the art of electrical connectors and, particularly, to a latching system for holding a mating connector in mating engagement with a connector mounted on a backplane of an electrical apparatus.

BACKGROUND OF THE INVENTION

Backplane connector, as the name implies, are electrical connectors mounted on a backplane of an electrical apparatus and typically are receptacle type connectors defining a socket for receiving a board mounted plug-in type connector. These connectors are designed to be board to board connectors and are equipped with necessary hardware to provide physical latching and holding of the boards in place.

Frequently, it is necessary to provide interconnections between backplanes which is best accomplished with a wire harness having at least one end terminated in a plug-in connector, such as a mini-coax connector, which can mate with an existing backplane connector, however, neither the backplane connector nor the mini-coax connector have any latching means to physically latch the mini-coax connector to keep it in engagement with the backplane connector.

Retention of the plug-in mini-coax connector depends on the frictional interference developed between the electrical contacts of the two connectors.

Although such connectors usually are mated for long periods of time, the mating connectors cannot be permanently secured to the backplane connectors because of the interchangeability, replacement or repair of the mating connectors. The mated connectors remain interengaged under varying environmental situations. For instance, the mated connectors may be subject to vibrations, thermal cycling and other undesirable relative movement which may cause the mated connectors to become loosened and, in some situations, actually disconnected.

These miniature connector systems involving a backplane connector and a mating connector, such as for use with mini-coaxial cables, have no latching means to retain the connectors in mated condition. The connectors and their terminating components are very small, and it is very expensive to provide latching means therebetween by modification of backplane connectors. As a result, there are countless such connector systems presently in use which have no latching devices between the connectors and which continuously cause problems under varying environmental conditions, such as in vibration environments or under conditions of thermal cycling which can loosen the connector interengagement.

This invention is directed to a latching system which is independent of the mating connectors themselves and which, although quite useful for original installation with such miniaturized connectors, is very useful as a retrofitting system to maintain mating connectors in proper mating condition with backplane connectors.

SUMMARY OF THE INVENTION

An object, therefore, of the invention is to provide a new and improved latching system including a latching device for use in an electrical connector system which includes a backplane connector mounted on a backplane of an electrical apparatus, and at least one mating connector mateable with the backplane connector in a direction generally perpendicular to the backplane.

The invention contemplates that the latching device be independent of the backplane connector and the mating connector, with the device mounted adjacent the backplane connector. The latching device includes a latch element projecting from the backplane. Complementary interengaging latching surface means are provided between the latch element and the mating connector for holding the mating connector in mating condition with the backplane connector.

As disclosed herein, the latching device is mounted on the backplane adjacent the backplane connector. The complementary interengaging latching surface means include a hook portion on the latch element overlying a latching surface on the mating connector when in its mated condition. The latch element is provided in the form of a latch arm to provide for flexing movement of the hook portion generally parallel to the backplane, i.e. generally transverse to the mating direction of the mating connector.

A feature of the invention is providing the hook portion with a cam surface engageable by the mating connector during movement of the mating connector into its mated condition, to thereby move the hook portion out of the path of movement of the mating connector and whereby the hook portion automatically moves to its latching position in response to its resiliency.

Another feature of the invention is to provide a plurality of the hooked latching devices along a strip thereof. The strip can be cut to any length and mounted to the backplane alongside the backplane connector, with a given number of the hooked latch arms equal to the number of mating connectors mated to the elongated backplane connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figures 1, 2:
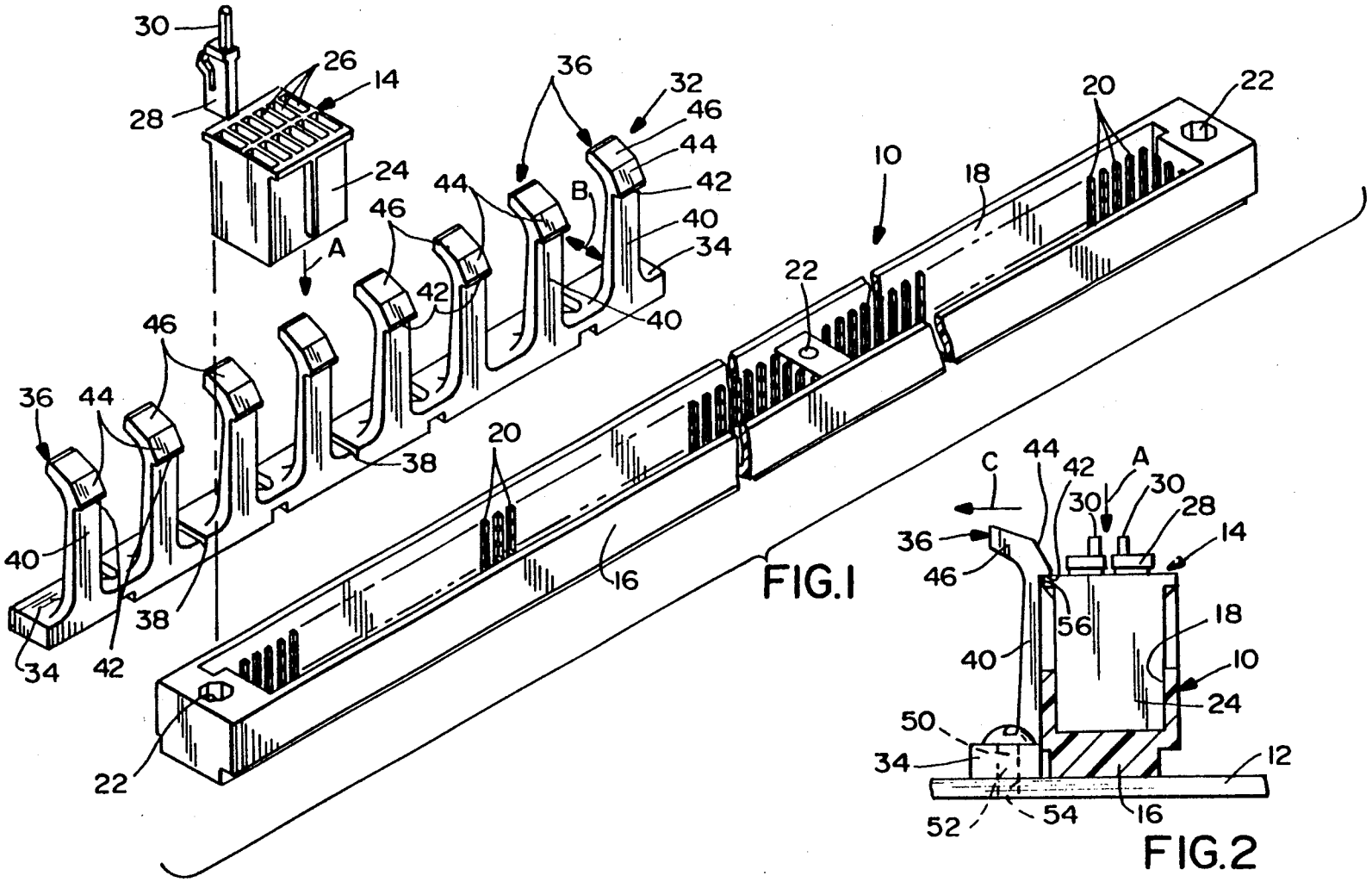
FIG. 1 is an exploded perspective view of an elongated backplane connector in conjunction with a mating connector and the latching system of the invention.
FIG. 2 is a vertical section through the mated backplane connector and mating connector, with the latching device of the invention in its latching condition with the mating connector.

Referring to the drawings in greater detail, and first to FIG. 1, the latching system of the invention is designed particularly for use with a backplane connector, generally designated 10, mounted on a backplane 12 (see FIG. 2) of an appropriate electrical apparatus, along with one or more mating connectors, generally designated 14, which is mateable with the backplane connector in a direction generally perpendicular to the backplane, as indicated by arrow "A".

Backplane connector 10 includes an elongated housing 16 unitarily molded of dielectric material and including an elongated receptacle 18 running substantially the entire length of the housing. The housing mounts a plurality of terminal pins 20 projecting into receptacle 18, the terminal pins having tail portions or surface mounting portions (not shown) for appropriate interconnection with circuit traces on backplane 12, as by soldering. Apertures 22 are provided in housing 16 through which appropriate fastening means can be inserted to mount the backplane connector to the backplane.

Each mating connector 14 includes a dielectric housing 24 sized to fit within receptacle 18 of backplane connector 10. The housing includes a plurality of sockets 26 for receiving terminal modules 28 each terminating a mini-coaxial cable 30. In order not to clutter the drawing, only one module 28 is shown in FIG. 1 for positioning into one of the sockets 26. Each module includes a female terminal (not shown) for receiving one of the terminal pins 20 of the backplane connector. In addition, again to not clutter the depiction of the drawing, only one mating connector 14 is shown in FIG. 1, but it should be understood that a plurality of mating connectors 14 can be positioned into mating condition within elongated receptacle 18 of backplane connector 10, in a side-by-side relationship along the entire length of the backplane connector if so desired.

The invention contemplates a latching system, generally designated 32 (FIG. 1), in which an elongated strip 34 has a plurality of spaced latching devices, generally designated 36, projecting away from strip 34 along the length thereof. At this point, a feature of the invention should be described in relation to the number of mating connectors 14 which are mated with backplane connector 10.

Specifically, the invention is particularly applicable for retrofitting an existing electrical connector system which includes one of the backplane connectors 10 and a given number of mated connectors 14. In other words, the backplane connector 10 and any given number of mating connectors 14 may already be in service mounted and mated on a backplane of a particular electrical apparatus. Rather than having a latching strip 34 running along the entire length of the backplane connector, if only one or a few mating connectors 14 are mated with the elongated backplane connector, strip 34 can be cut to any given length in order to provide whatever number of latching devices 36 are necessary for latching a particular number of mating connectors 14 in mated condition with the backplane connector. To this end, weakened areas 38 are provided on strip 34 to facilitate severing the strip to any given length. The strip, along with latching devices 34, is unitarily molded of dielectric material such as plastic or the like.

Each latching device 36 is provided in the form of a resilient latch arm 40 projecting away from strip 34 in a direction opposite arrow "A", i.e. the resilient latch arms project generally perpendicularly away from backplane 12 (FIG. 2). Each resilient latch arm includes a hook portion 42 near the distal end thereof. A cam surface 44 is formed adjacent the hook portion, and a releasing portion 46 projects transversely of the resilient latch arm away from cam surface 44.

Referring to FIG. 2, mating connector 14 is shown inserted into receptacle 18 of backplane connector 10 in the fully mated condition of the mating connector, with the backplane connector appropriately mounted to backplane or printed circuit board 12. One of the latching devices 36 of latching system 32 (FIG. 1) is shown in FIG. 2 in its latching condition with mating connector 14 to hold the mating connector in its mated condition within receptacle 18 of backplane connector 10. In particular, it can be seen that hook portion 42 overlies the top surface of housing 24 of mating connector 14. The latching device is mounted to backplane 12 adjacent backplane connector 10 by means of appropriate fasteners, such as bolts or screws 50 extending through apertures 52 and threaded into appropriate holes 54 in backplane 12. In the alternate, the latching device may be mounted on a side of the backplane connector 10.

In operation of the latching system of the invention, with the components of the system being fabricated of plastic material, each latch arm 40 is resilient to provide for flexing movement of hook portion 42 generally parallel to backplane 12, out of the mating path of movement of connector 14 as indicated by double-headed arrow "B" (FIG. 1). In the unstressed or "non-flexed" condition of latch arm 40, hook portion 42 is located in the mating path of mating connector 14. In the particular configuration of mating connector 14 shown in FIG. 2, housing 24 includes an outwardly projecting flange 56 which defines the upper latching surface for complementary interengagement with hook portion 42 of latching device 36. When mating connector 14 is inserted into receptacle 18 of backplane connector 10, flange 56 engages cam surface 44 and biases latch arm 40 outwardly in the direction of arrow "C" (FIG. 2) and, in turn, moves hook portion 42 out of the path of movement of the flange. When the mating connector reaches its fully mated condition as shown in FIG. 2, the latch arm will snap back, opposite the direction of arrow "C", under its own resiliency and automatically move hook portion 42 into latching engagement with the top of mating connector 14. When it is desired to remove the mating connector, a user engages releasing portion 46 and flexes the latch arm again in the direction of arrow "C" to move the hook portion out of locking engagement with the top of the mating connector, whereupon the mating connector can be unmated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical connector system which includes a backplane connector mounted on a backplane of an electrical apparatus, and a mating connector mateable with the backplane connector in a direction generally perpendicular to the backplane, the improvement comprising a latching device mounted on the backplane independent of said connectors and adjacent the backplane connector, and including a latch element projecting from the backplane, and complementary interengaging latching surface means between the latch element and the mating connector for holding the mating connector in mated condition with the backplane connector, the latching device detachable from said connectors when they are mated together.

2. In an electrical connector system as set forth in claim 1, including means for mounting the latching device on the backplane adjacent the backplane connector.

3. In an electrical connector system as set forth in claim 1, wherein said complementary interengaging latching surface means include a hook portion on the latch element overlying a latching surface on the mating connector when in its mated condition.

4. In an electrical connector system as set forth in claim 3, wherein said latch element comprises a resilient latch arm to provide for flexing movement of said hook portion generally parallel to the backplane.

5. In an electrical connector system as set forth in claim 4, wherein said hook portion includes a cam surface engageable by the mating connector during movement of the mating connector into its mated condition with the backplane connector to thereby move the hook portion out of the path of movement of the mating connector and whereby the hook portion automatically moves to its latching position in response to the resiliency of the latch arm.

6. In an electrical connector system as set forth in claim 1, wherein said latching device includes an elongated strip having a plurality of said latch elements projecting from the strip one after another therealong, the strip being severable to present a given number of the latch elements complementary to a given number of said mating connectors mated with the backplane connector.

7. In an electrical connector system which includes an elongated backplane connector mounted on a backplane of an electrical apparatus, and a plurality of mating connectors mateable with the backplane connector in a direction generally perpendicular to the backplane, the mating connectors when mated being disposed one after another along the length of the backplane connector, the improvement comprising a latch system mounted on the backplane and including an elongated base mounted along and adjacent the backplane connector, and a plurality of latch elements projecting from and spaced along the base adjacent respective ones of the plurality of mating connectors, complementary interengaging latching surface means between each latch element and a respective mating connector for holding the mating connectors in mating condition with the backplane connector, the latching device detachable from said connectors when they are mated together.

8. In an electrical connector system as set forth in claim 7, wherein said base is severable to present a given number of said latch elements complementary to a given number of the plurality of mating connectors.

9. In an electrical connector system as set forth in claim 7, including means for mounting the base on the backplane alongside the elongated backplane connector.

10. In an electrical connector system as set forth in claim 7, wherein said complementary interengaging latching surface means include a hook portion on each latch element overlying a latching surface on a respective mating connector when in its mating condition.

11. In an electrical connector system as set forth in claim 10, wherein each latch element comprises a resilient latch arm to provide for flexing movement of its respective hook portion generally parallel to the backplane.

12. In an electrical connector system as set forth in claim 11, wherein each hook portion includes a cam surface engageable by the respective mating connector during movement of the mating connector into its mated condition with the backplane connector to thereby move the hook portion out of the path of movement of the mating connector and whereby the hook portion automatically moves to its latching position in response to the resiliency of the latch arm.

* * * * *